United States Patent [19]

Dahlborg

[11] Patent Number: 4,476,699

[45] Date of Patent: Oct. 16, 1984

[54] LOCKING DEVICE, ESPECIALLY INTENDED TO PREVENT STEALING OF BOATS PROVIDED WITH OUTBOARD MOTORS

[75] Inventor: Christer Dahlborg, Täby, Sweden

[73] Assignee: Cowab AB, Täby, Sweden

[21] Appl. No.: 474,590

[22] PCT Filed: Jul. 13, 1982

[86] PCT No.: PCT/SE82/00242

§ 371 Date: Mar. 4, 1983

§ 102(e) Date: Mar. 4, 1983

[87] PCT Pub. No.: WO83/00353

PCT Pub. Date: Feb. 3, 1983

[30] Foreign Application Priority Data

Jul. 15, 1981 [SE] Sweden ..... 8104391

[51] Int. Cl.[3] ..... E05B 67/36

[52] U.S. Cl. ..... 70/34; 70/57; 70/163; 70/170; 70/178; 70/242; 138/89

[58] Field of Search ..... 70/31–34, 70/177–179, 14, 39, 57, 58, 170, 171, 166, 167, 163, 242, 244, 175, 176, 230, 232; 138/89, 96

[56] References Cited

U.S. PATENT DOCUMENTS 1,329,943 2/1920 Weller et al. ..... 70/242
2,623,378 12/1952 Haver ..... 70/49
2,904,121 9/1959 Honeyman ..... 70/242 X
3,345,710 10/1967 Bush ..... 24/597
4,236,395 12/1980 Avaiusini ..... 70/34

FOREIGN PATENT DOCUMENTS 7712925-2 5/1979 Sweden .
7801076-6 7/1979 Sweden .

*Primary Examiner*—Robert L. Wolfe
*Assistant Examiner*—Thomas J. Dubnicka
*Attorney, Agent, or Firm*—Mason, Kolehmainen, Rathburn & Wyss

[57] ABSTRACT

A locking device intended to be mounted on a fuel pipe nipple (15), which is provided with bayonet locking pins, so as to make it impossible to connect a fuel hose coupling to an outboard motor on a boat. The locking device comprises an elongated external sleeve (1), which at one end is provided with an internally situated lock (6) and at the other end with bayonet locking grooves (20,21,22,23) corresponding to the bayonet locking pins (16). The lock (6) has an axially movable locking piston (9) cooperating with an internal sleeve (14) which is axially displaceable inside the external sleeve (1) between a retracted first position, which permits relative interconnection and release, respectively, of the pipe nipple (15) and the locking device, and an advanced, second position in which the bayonet locking pins (16) are kept securely fixed in the bayonet locking grooves (22,23).

6 Claims, 3 Drawing Figures

LOCKING DEVICE, ESPECIALLY INTENDED TO PREVENT STEALING OF BOATS PROVIDED WITH OUTBOARD MOTORS

The invention relates to a locking device of the kind stated in the preamble of appended claim 1. The locking device is primarily intended to be mounted on the fuel pipe nipple of an outboard motor so as to make it impossible to connect a fuel hose coupling and run the motor.

Such a locking device is known from the Swedish Laid-open Print No. 7801076-6. However, the known locking device is rather complicated and consists of a plurality of mutually movable parts, namely an external sleeve, an internal sleeve, a cylinder-type lock, a ball for axially securing the sleeves in a locking position and a coil spring acting axially between the sleeves and located at the outside of the internal sleeve.

The object of the present invention is to achieve a similar, but simplified locking device, comprising fewer parts, in particular without an external spring, and enabling a rational manufacture thereof and improved functional reliability.

This object is achieved by a locking device as defined in claim 1. Further advantageous features appear from claims 2 through 6.

The invention will be explained further below with reference to the appended drawing which illustrates a preferred embodiment.

Figure 1:
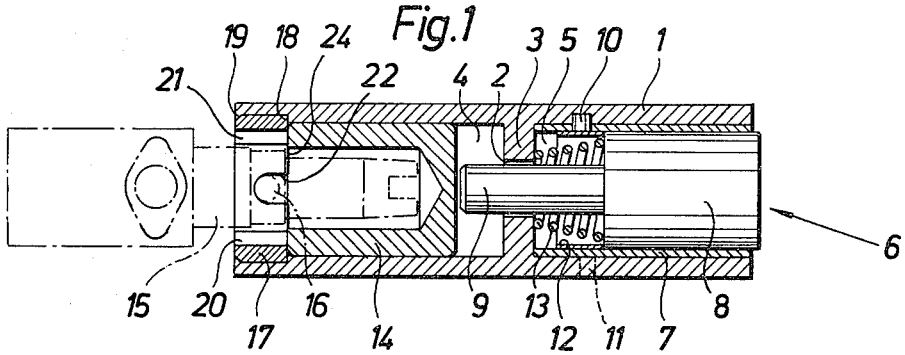
FIG. 1 shows an axial section through a locking device according to the invention, the device being in a locking position on a fuel pipe nipple indicated by a dashed line.
Figure 2:
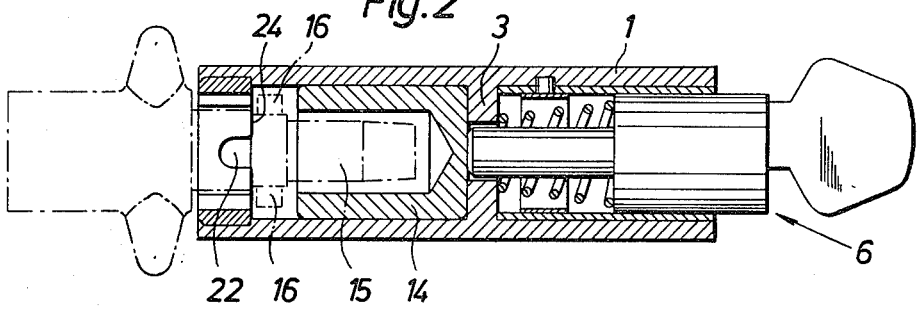
FIG. 2 shows the locking device in an open position.

As shown in FIGS. 1 and 2, the inventive locking device comprises an elongated external sleeve 1 of aluminum. A partition wall 3 provided with a central hole 2 divides the interior of the external sleeve into two cylindrical chambers 4 and 5.

The chamber 5 to the right in FIGS. 1 and 2 contains a standard lock 6 of the press button type being commercially available. This lock 6 consists of a cylindrical casing 7 and a cylinder lock 8 axially displaceable therein and having a central piston 9 extending through the central hole 2 of the partition wall 3. The casing is secured in a fixed position by means of a pin 10, which extends through a corresponding hole in the casing 7 into a blind hole in the external sleeve. This blind hole has been formed by drilling through an opposite hole 11 (dashed) in the external sleeve 1. Thereafter, the hole 11 has been filled. The pin 10 is secured to a ribbon spring 12 of spring steel mounted circumferentially at the inside of the casing. In this way, when mounting the lock unit 6, the latter can be inserted into the chamber 5, whereby the pin 10 snaps automatically into the blind hole of the external sleeve upon reaching its correct position. Thereafter, the casing 7 of the lock unit 6 is securely fastened inside the external sleeve 1.

Against the action of a conical pressure spring 13, the cylinder lock 8, preferably without the key, can be pushed from the position shown in FIG. 2 into the position shown in FIG. 1, so that the locking piston 9 is inserted axially somewhat into the second chamber 4 shown to the left in FIGS. 1 and 2.

In the second chamber 4 there is an axially freely movable, internal sleeve 14 also made of aluminum and closed at one of its end positions (to the right in FIGS. 1 and 2), so that it can be actuated by the piston 9. Moreover, the inside of the internal sleeve 14 is entirely open and dimensioned so as to receive the end portion of the pipe nipple 15, shown dashed in FIG. 1, without contact.

The pipe nipple 15 is of a conventional type used in outboard motors and intended to be connected to a fuel hose by means of a bayonet coupling being provided with two diametrically opposed, transversally protruding bayonet locking pins 16. To enable the connection to the pipe nipple 15 (instead of a fuel hose coupling), the external sleeve 1, in the region of the free opening of the chamber 4, is provided with a sleeve portion having a smaller inner diameter, namely in the form of a separate ring 17 likewise made of aluminum and maintained in the internal end portion of the external sleeve 1 between an internal shoulder surface 18 and a deformed portion 19 at the end of the external sleeve 1.

Figure 3:
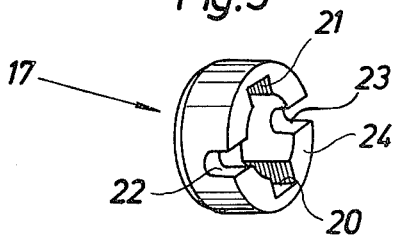
FIG. 3 shows in a perspective view a ring included in the locking device and having bayonet locking grooves.

The ring 17, which is shown further in perspective view in FIG. 3, has two diametrically opposed grooves 20, 21 extending axially and internally along its entire length and dimensioned to receive the bayonet locking pins 16, when the entire locking device as shown in FIG. 2 is mounted onto the pipe nipple 15. Moreover, the ring 17 is provided with two opposite grooves or recesses 22,23 displaced circumferentially relative to the grooves 20,21, preferably 90°, and starting from the inner end surface 24 of the ring (to the left in FIG. 1) and extending axially so far that the respective bayonet locking pin 16 can be received therein in its entire width, as shown in FIG. 1. The outer diameter of the ring 17 is considerably larger than the inner diameter of the external sleeve 1 and its internal diameter is considerably smaller, so that the end surface 24 of the ring forms a stop surface for the freely movable, internal sleeve 14.

When the locking device is positioned in its open position according to FIG. 2, the internal sleeve 14 is freely axially movable in the chamber 4 between the end surface 24 of the ring 17 and the partition wall 3. Thus, the locking device can be mounted onto the pipe nipple 15 by axially pushing on the same so far that the bayonet locking pins 16 pass the ring 17 through the grooves 20, 21, whereupon the locking device is turned circumferentially an angle corresponding to the displacement of the grooves 22,23 relative to the grooves 20,21. Thereafter, the locking device (the external sleeve 1) can be drawn back somewhat, so that the bayonet locking pins are received in the grooves or recesses 22,23. Finally, the cylinder lock 8 is pushed in, so that the piston 9 pushes the internal sleeve 14 forwardly to an end position in which it contacts the end surface 24 of the ring, whereby the bayonet locking pins 16 are kept effectively secured in the locking position shown in FIG. 1. Upon opening the lock 8 with a key, the external sleeve can be pushed somewhat inwardly, be turned appr. 90° and be pulled out again, thereby disengaging the pipe nipple 15 entirely.

It is understood that the described locking device is easy to manufacture (the aluminum parts are preferably formed by pressure die casting), assemble and use. There is no external spring, and the functional reliability is very good.

I claim:

1. Locking device intended to be mounted on a fuel pipe nipple (15) providing with bayonet locking pins (16), comprising an elongated external sleeve (1), having at one end an internally situated lock (6) and at the other end bayonet locking grooves (20,21,22,23) corresponding to said bayonet locking pins, characterized in that the lock (6) has an axially movable locking piston (9) cooperating with an internal sleeve (14), which is axially displaceable inside the external sleeve (1) between a retracted, first position (FIG. 2), which permits relative interconnection and release of the pipe nipple and the locking device, and an advanced, second position (FIG. 1), in which the bayonet locking pins (16) are kept securely fixed in the bayonet locking grooves (22,23).

2. Locking device as defined in claim 1, characterized in that the bayonet grooves (20,21,22,23) are formed in a sleeve portion (17) of a diameter smaller than the adjacent inner diameter of the external sleeve (1), so that an internal shoulder surface (24) is formed and the displaceable internal sleeve (14) in said second position contacts said shoulder while locking the bayonet locking pins (16).

3. Locking device as defined in claim 2, characterized in that said sleeve portion consists of a ring (17) internally fixed in the external sleeve.

4. Locking device as defined in claim 3, characterized in that the ring is pressed between an internal shoulder (18) in the external sleeve (1) and a deformed portion (19) of the end of the external sleeve.

5. Locking device as defined in claim 1, characterized in that the bayonet grooves comprise two diametrically opposed first grooves (20,21) extending along the whole of said sleeve portion, and two shorter, likewise diametrically opposed, second grooves (22,23) extending from said internal shoulder to receive the bayonet locking pins (16) in a locking position (FIG. 1).

6. Locking device as defined in claim 1, characterized in that the internal sleeve (14) is axially freely movable between said first and second positions, when the locking piston (9) is situated in an open position (FIG. 2).

* * * * *